US005392476A

United States Patent [19]

Williams

[11] Patent Number: 5,392,476

[45] Date of Patent: Feb. 28, 1995

[54] COLLAPSIBLE HAMMOCK STAND

[76] Inventor: Richard L. Williams, 7514 SW. 58 Ave., Miami, Fla. 33143

[21] Appl. No.: 220,381

[22] Filed: Mar. 30, 1994

[51] Int. Cl.[6] ..... A45F 3/24

[52] U.S. Cl. ..... 5/127; 5/129; 248/166

[58] Field of Search ..... 5/127–129; 248/166, 171

[56] References Cited

U.S. PATENT DOCUMENTS

| | | | |
|---|---|---|---|
| D. 295,242 | 4/1988 | Frick et al. | D6/387 |
| 320,174 | 6/1885 | Rudd et al. | 5/129 |
| 337,792 | 3/1886 | Rudd et al. | 5/129 |
| 381,025 | 10/1888 | Parmalee | 5/129 X |
| 506,776 | 10/1893 | Ford | 5/129 |
| 531,727 | 1/1895 | Keegan et al. | 5/129 |
| 593,583 | 11/1897 | Jeffares | 5/129 |
| 711,579 | 10/1902 | Morehouse | 5/129 |
| 933,921 | 9/1909 | Patterson | 5/129 |
| 1,229,537 | 8/1917 | Sishower et al. | 5/127 |
| 3,593,352 | 7/1971 | Britt | 5/127 |
| 4,925,138 | 5/1990 | Rawlins | 248/165 |
| 5,003,652 | 4/1991 | Bayless | 5/129 |

*Primary Examiner*—Michael F. Trettel
*Attorney, Agent, or Firm*—Robert J. Koch

[57] ABSTRACT

A collapsible hammock stand is provided for suspending a hammock above the ground. The collapsible hammock stand includes a collapsible longitudinal base member having lateral ground engaging support members at each end. The hammock stand also includes upright supports extending upwardly from the ends of the longitudinal base member for selectively receiving the ends of a hammock. The various components of the hammock stand are pivot and/or slide mounted to one another, which allows the hammock stand to be collapsed quickly and easily for transportation. The hammock stand is of a one-piece construction to prevent misplacement of the various individual components.

21 Claims, 10 Drawing Sheets

Fig. 8b
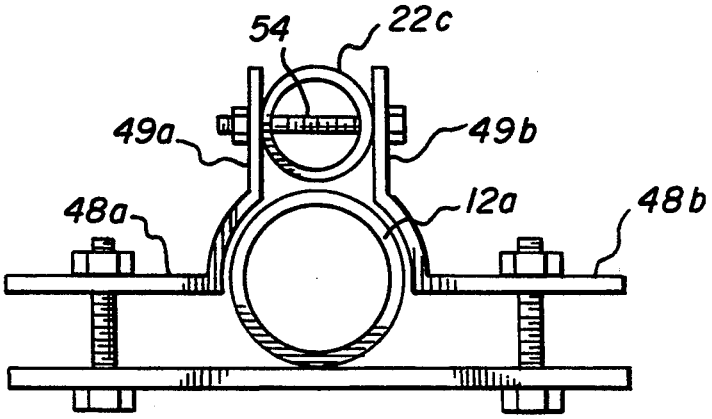
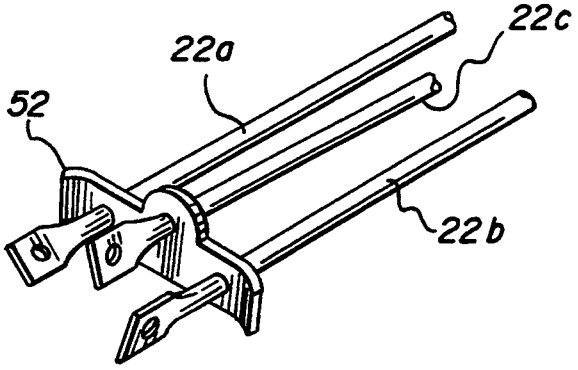
Fig. 9

COLLAPSIBLE HAMMOCK STAND

BACKGROUND OF THE INVENTION

1. Field of the Invention

The present invention relates to a stand for suspending and supporting a hammock above the ground. More particularly, the invention concerns a light-weight, one-piece hammock stand which may be collapsed easily and quickly and transported from one place to another.

2. Description of the Related Technology

For many years hammocks have been a popular recreational device for accommodating individuals in a reclining position. In order to provide the necessary support for the hammock, stable support structures located at each end of the hammock are necessary. Traditionally, hammocks have been strung between trees, up-right poles, and other convenient, relatively stable structures. However, these stable support structures do not normally exist in areas which are most desirable for the use of a hammock, such as the beach or open sunny areas of the yard. Accordingly, various devices have been proposed for providing the necessary support for suspending a hammock so that it may swing freely above the ground. However, such structures by nature are quite large and heavy since they must not only accommodate a hammock between their ends, but must also support the weight of a person lying therein. These large, heavy hammock support stands cannot easily be moved from one place to another. Furthermore, such hammock stands are normally formed from several separate components which can easily be mislaid during disassembly and storage. Accordingly, the need exists for a hammock support stand which is light-weight and can be collapsed or folded to allow for easy transportation from one place to another. There also exists a need for a collapsible hammock stand which can be easily and quickly unfolded and set up in the desired location. There exists a further need for a hammock stand wherein all components are attached in a one-piece construction to prevent components of the hammock stand from being mislaid.

SUMMARY OF THE INVENTION

The present invention is directed to a collapsible hammock stand which is light-weight, easily collapsible and transportable, and one-piece. A hammock stand having features of the present invention comprises a base member having a hinge located at a central portion thereof, lateral support members located proximal to the ends of the base member, upright support members extending upwardly from the ends of the base member for receiving ends of the hammock, and strut members for providing additional stability and bracing support to the upright support members. The upright support members are spaced apart a sufficient distance to receive an outstretched hammock therebetween. The components of the collapsible hammock stand are preferably fabricated from light-weight tubular parts such as aluminum, plastic or composite fibers. The hammock stand may be folded or unfolded quickly and easily without need for assembling any separate parts.

It is an object of the present invention to provide a collapsible hammock stand wherein the support framework is fabricated from light-weight materials, such as aluminum, plastic or composite fibers. Another object of the invention is to provide a collapsible hammock stand which may be unfolded quickly and easily from a collapsed configuration into a self-supporting structure for suspending a hammock above the ground.

A further object of the invention is to provide a collapsible hammock stand which, in its collapsed configuration, is light-weight and compact, so that it may be easily transported. Another object of the invention is to provide a one-piece hammock stand whereby all components thereof are interconnected.

These and other features, aspects, and advantages of the present invention will become better understood with regard to the following description, claims, and accompanying drawings.

BRIEF DESCRIPTION OF THE DRAWINGS

FIG. 8*b* is a sectional end view in elevation of a second embodiment of a sliding bracket according to the first embodiment of the present invention shown in FIGS. 1–7;

FIG. 9 is an enlarged perspective view of a strut retaining bracket and struts according to an alternative embodiment of the invention;

DETAILED DESCRIPTION OF THE PREFERRED EMBODIMENTS

Referring now in detail to the drawings for the purpose of illustrating the present invention, an improved collapsible hammock stand 13 according to a first embodiment is shown in FIGS. 1–8. The hammock stand according to the first embodiment comprises a longitudinal base member 12; first and second upright support members 14 and 16, each support member pivot mounted to an end of said base member 12; lateral support members 18 and 20 located proximal to each end said base member 12 for providing lateral support for the hammock stand 13; and a plurality of bracing supports, such as struts 22*a*, 22*b*, and 22*c*, pivot and/or slide mounted at a first end to one of said lateral support members 18 and 20 and removably fastened to one of said upright support members 14 and 16, respectively, at a second end thereof for providing additional lateral and longitudinal support to said upright support members 14 and 16.

Figure 1:
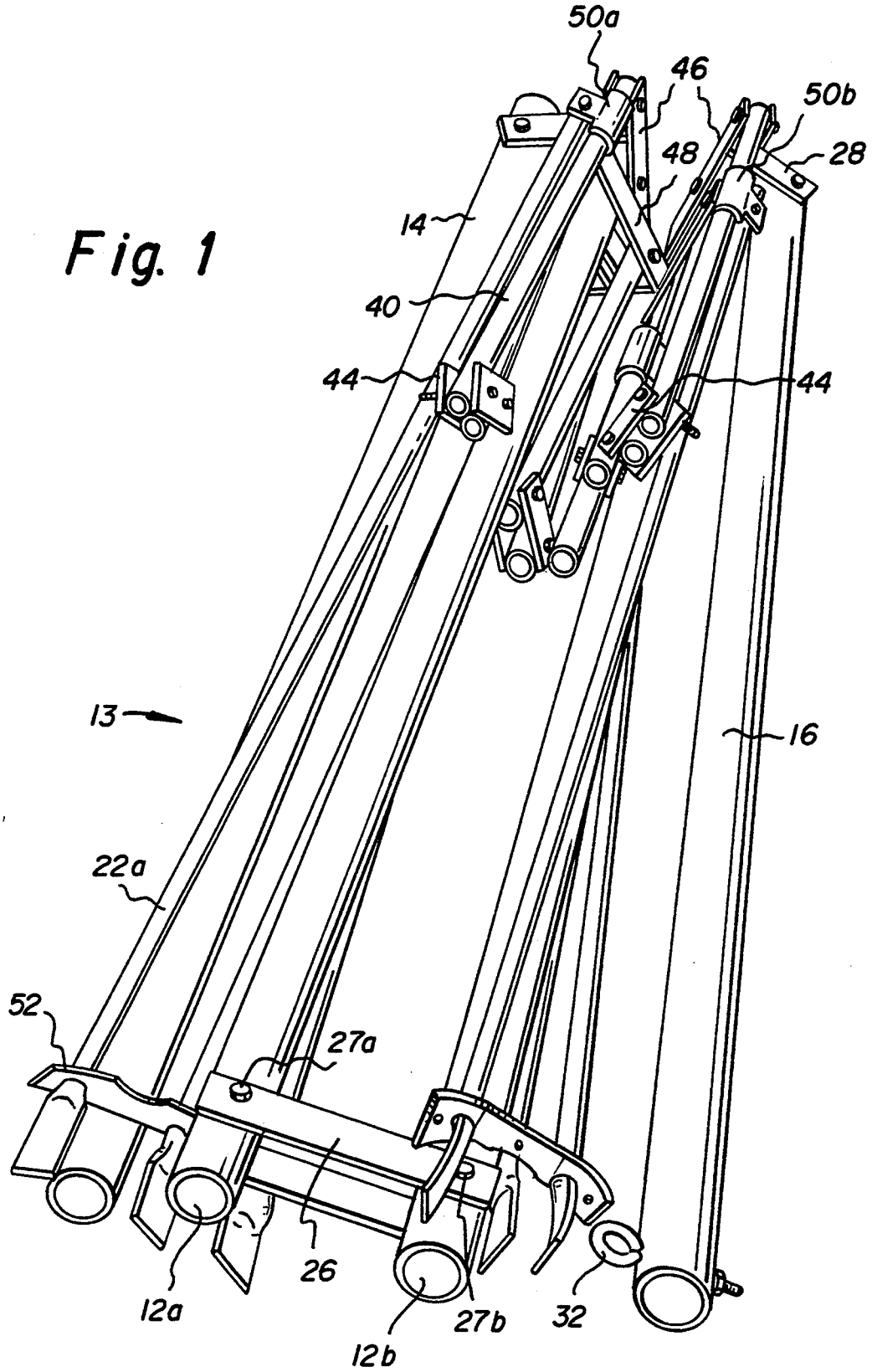
FIG. 1 perspective view of a first embodiment of the invention in a collapsed, transportable configuration.
Figure 2:
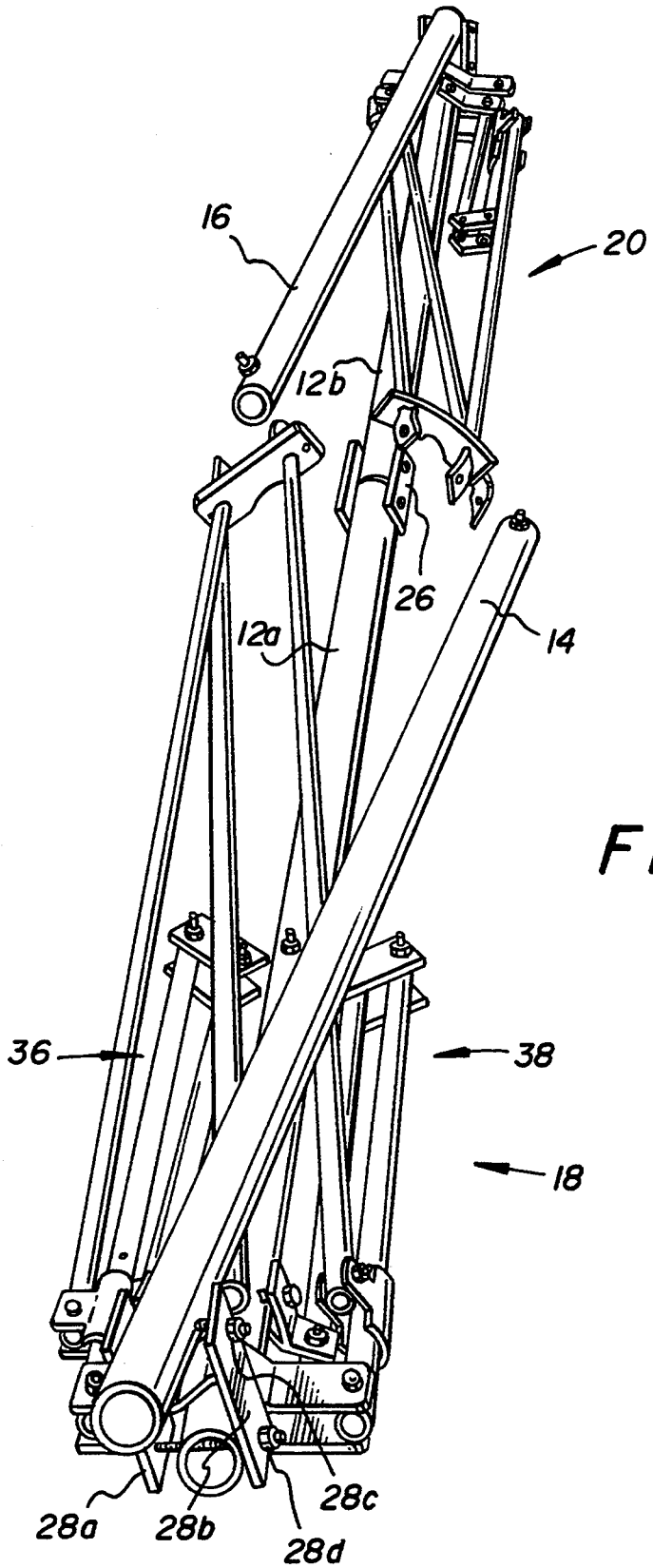
FIG. 2 is a perspective view of the embodiment shown in FIG. 1 in a partially unfolded configuration.

Base member 12 includes a first longitudinal base member 12*a* and a second longitudinal base member 12*b*. A first end of said first base member 12*a* is pivotally connected to a first end of said second base member 12*b* by a hinge 26 having a generally U-shaped cross sectional configuration. The hinge 26 is connected to the first ends of said first and second base members 12*a* and 12*b* by fasteners 27*a* and 27*b*, such as bolts or rivets, which allow for pivotal movement of the base member about the longitudinal axis of the fastener. In the collapsed configuration, as shown in FIG. 1, the hinge 26 limits the rotation of said first and second base members 12*a* and 12*b* so that said first base member is disposed substantially parallel to said second base member. When the first and second base members are unfolded, as best shown in FIG. 2, they are disposed in a substantially in-line position. The hinge 26 limits the pivotal movement of the first and second base members so that they do not extend beyond this substantially in-line position in the extended configuration.

Figure 3:
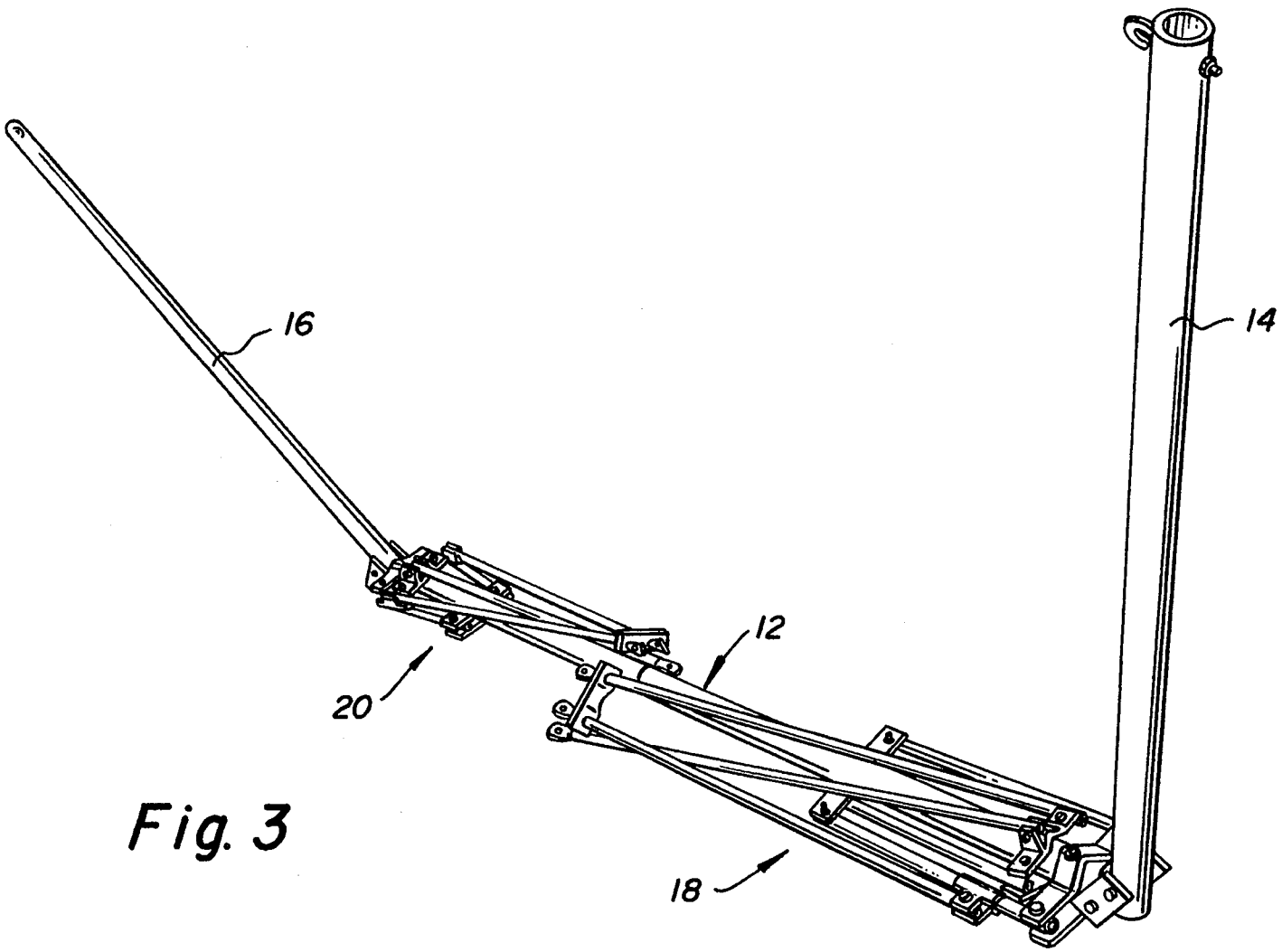
FIG. 3 is a perspective view of the embodiment shown in FIGS. 1 and 2 in a further unfolded configuration.

The second ends of said first and second base members 12*a* and 12*b* are pivotally connected to upright support members 14 and 16, respectively. Each of said first and second base members is pivotally connected to its respective upright support member by a hinge 28. According to the preferred embodiment, the hinge 28 is comprised of a first plate 28*a* disposed about an outer surface of one of said base members and one of said upright support members, a second plate 28*b* disposed about an outer surface of one of said base members and one of said upright support members which is diametrically opposed to said first plate 28*a*, and fasteners 28*c* and 28*d*, such as bolts or rivets, which allow for pivotal movement about a longitudinal axis thereof. The hinge 28 also serves to limit the pivotal range of motion of the upright support member in its raised operative position, as shown in FIG. 3. This is preferably accomplished by arrangement of an end of the base member and an end of the upright support member such that a portion of the end of the upright support member abuts the end of the base member thereby limiting the pivotal movement of the upright support member. The other end of each upright support member is provided with a fastener, such as eyelet 32 for detachably connecting one end of a hammock 60 to the upright support member.

Figure 4:
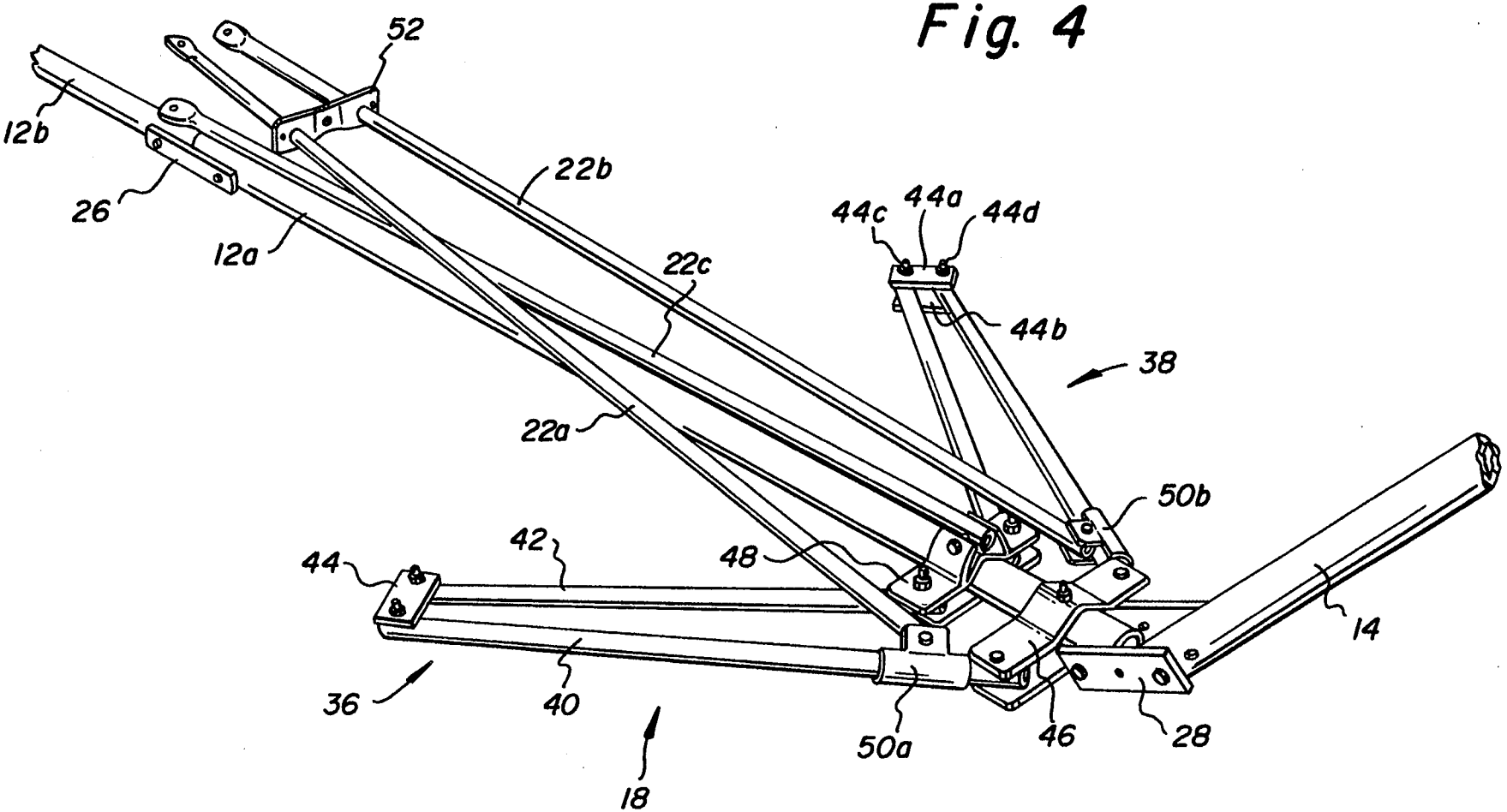
FIG. 4 is an enlarged perspective view of one end of the base of the embodiment shown in FIGS. 1–3 showing the outriggers in a partially unfolded configuration.
Figure 5:
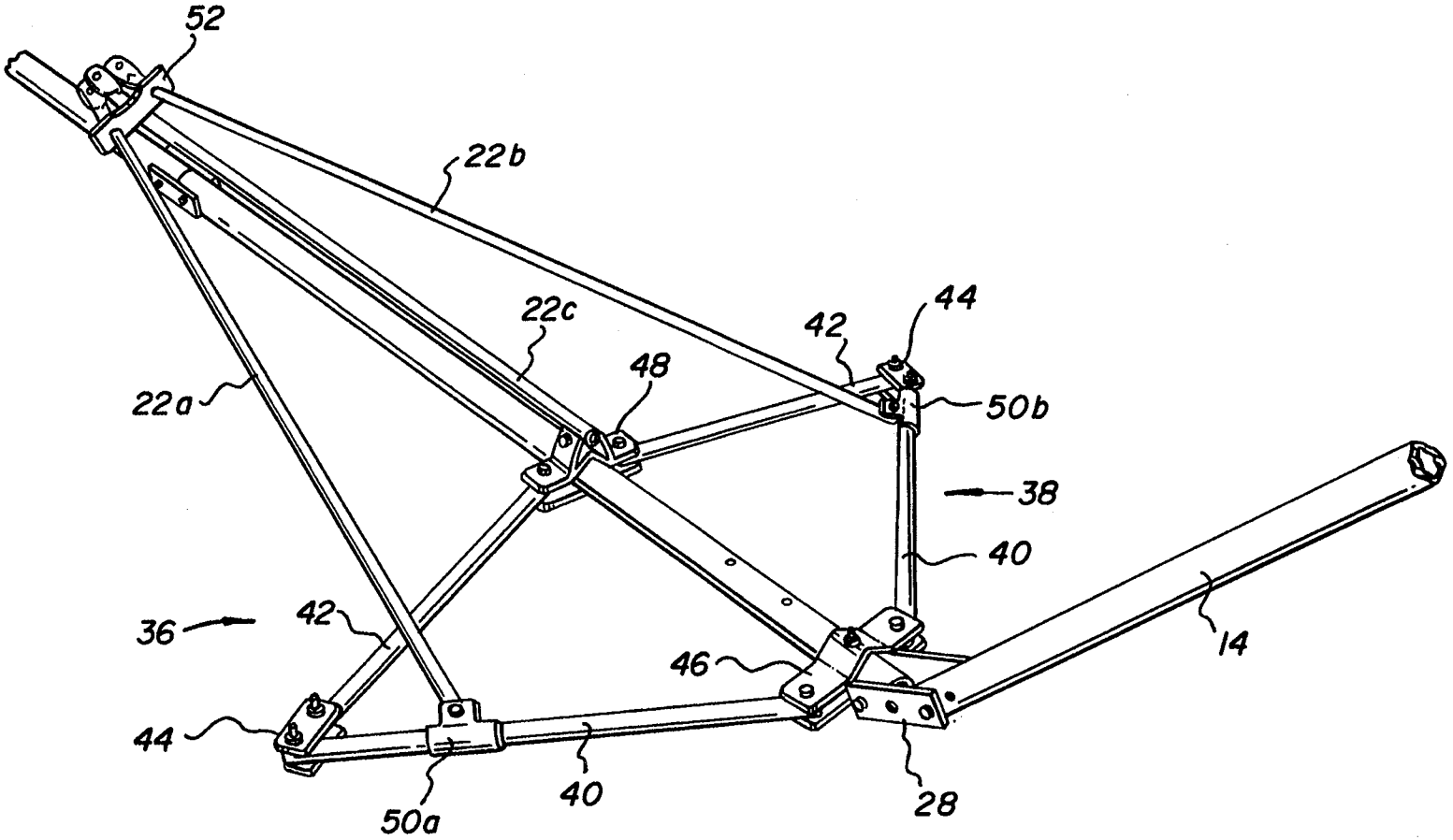
FIG. 5 is an enlarged perspective view of one end of the base of the embodiment shown in FIGS. 1–4 showing the outriggers in a completely unfolded configuration.
Figure 6:
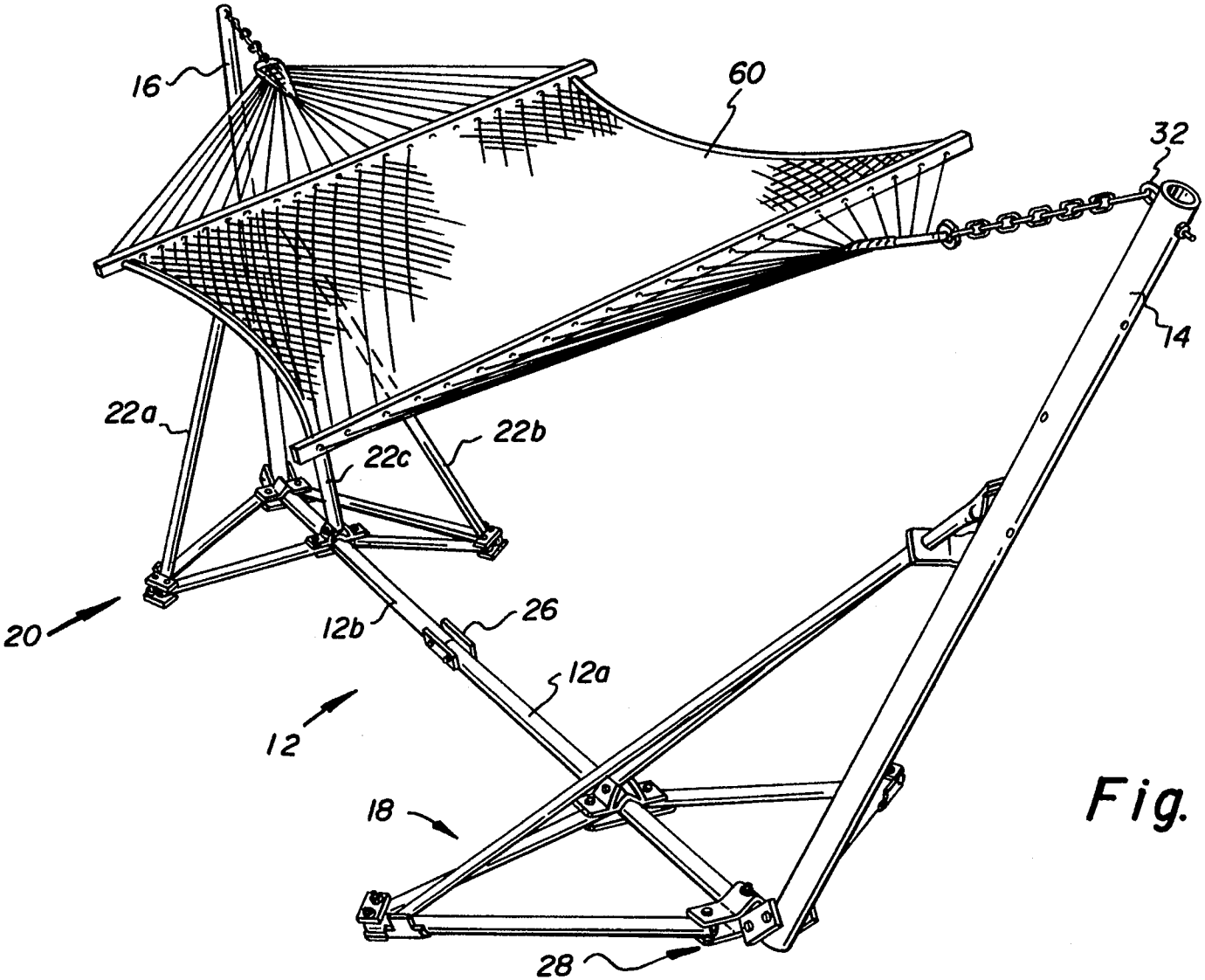
FIG. 6 is a perspective view of the embodiment shown in FIGS. 1–5 in a fully expanded hammock supporting configuration.
Figure 7:
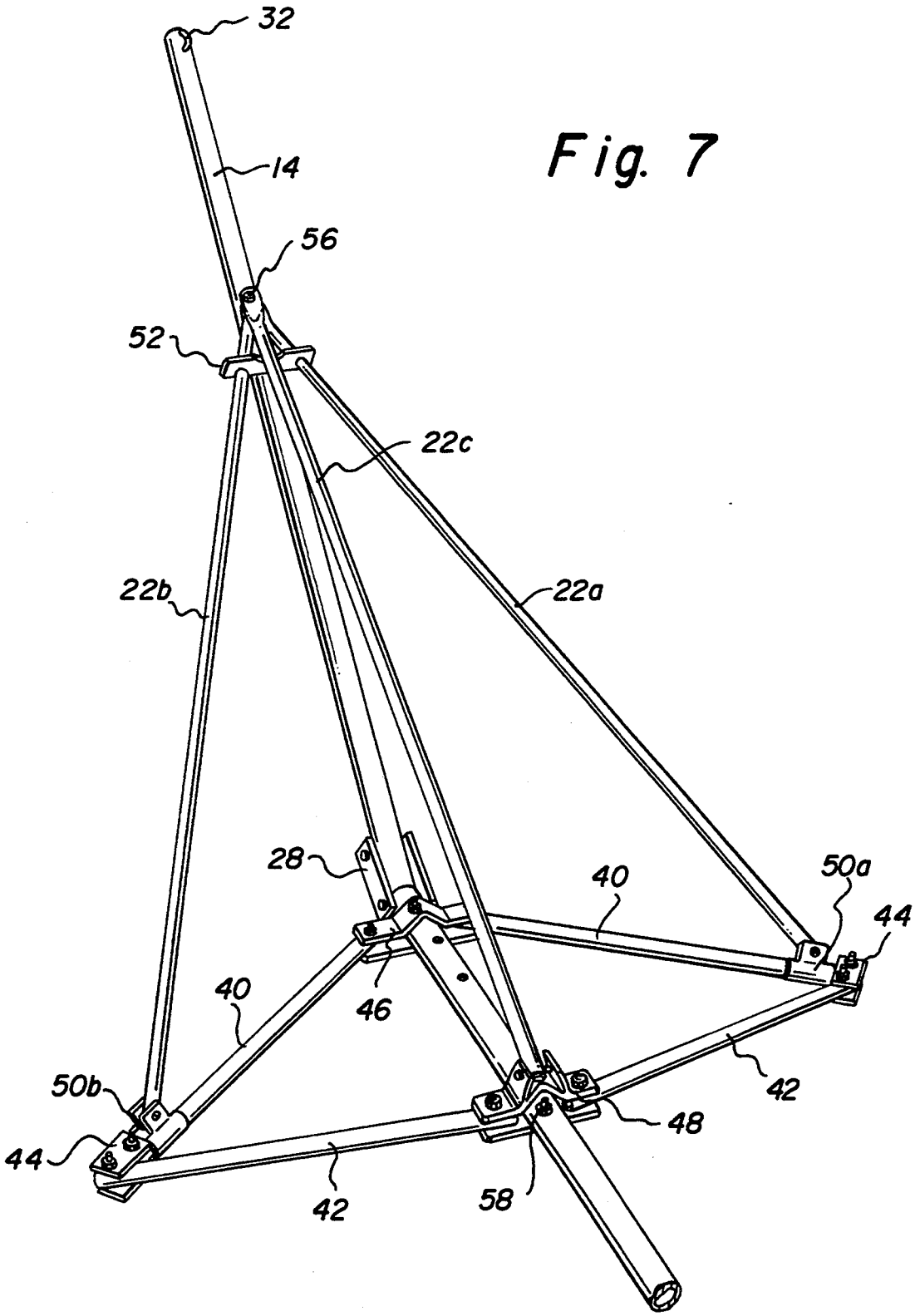
FIG. 7 is an enlarged perspective view of one end of the embodiment shown in FIG. 6.

The lateral support members 18 and 20 are extendable from a first, or collapsed position shown in FIGS. 1–3, to a second or use position, shown in FIGS. 5–7. FIG. 4 shows lateral support member 18 in a partially extended configuration. Each of the lateral support members 18 and 20 comprises a pair of outriggers 36 and 38. Each of the outriggers 36 and 38 comprises a first elongated support member 40 having a first end pivotally connected to a first end of a second elongated support member 42 by hinge 44. According to the preferred embodiment, hinge 44 is comprised of a first plate 44a disposed about an outer radial surface of said first and second elongated support members 40 and 4.2, a second plate disposed about an outer radial surface of said first and second elongated support members 40 and 42 diametrically opposed to said first plate 40, and fasteners 44*c* and 44*d*, such as bolts or rivets. A second end of said first elongated support member 40 is pivotally connected to a stationary bracket 46, said bracket being fixedly attached to an end of said base member 12. Similarly, as best seen in FIG.8, a second end of said elongated support member 42 is pivotally attached to a sliding bracket 48. The sliding bracket 48 is disposed about and slides along the longitudinal surface of the base member 12. In the collapsed configuration as shown in FIGS. 1–3, the sliding bracket 48 abuts the stationary bracket 46, and first and second elongated support members 40 and 42 are disposed substantially parallel to one another. When the hammock stand is unfolded, the outriggers 36 and 38 are extended outwardly by movement of the sliding bracket 48 away from the stationary bracket 46 located at the end of said base member 12, as shown in FIGS. 4 and 5 respectively. A stop 58, such as a bolt or rivet head, projects from a surface of the base member 12 thereby limiting the movement of the sliding bracket along the longitudinal axis of the base member 12.

Figure 8A:
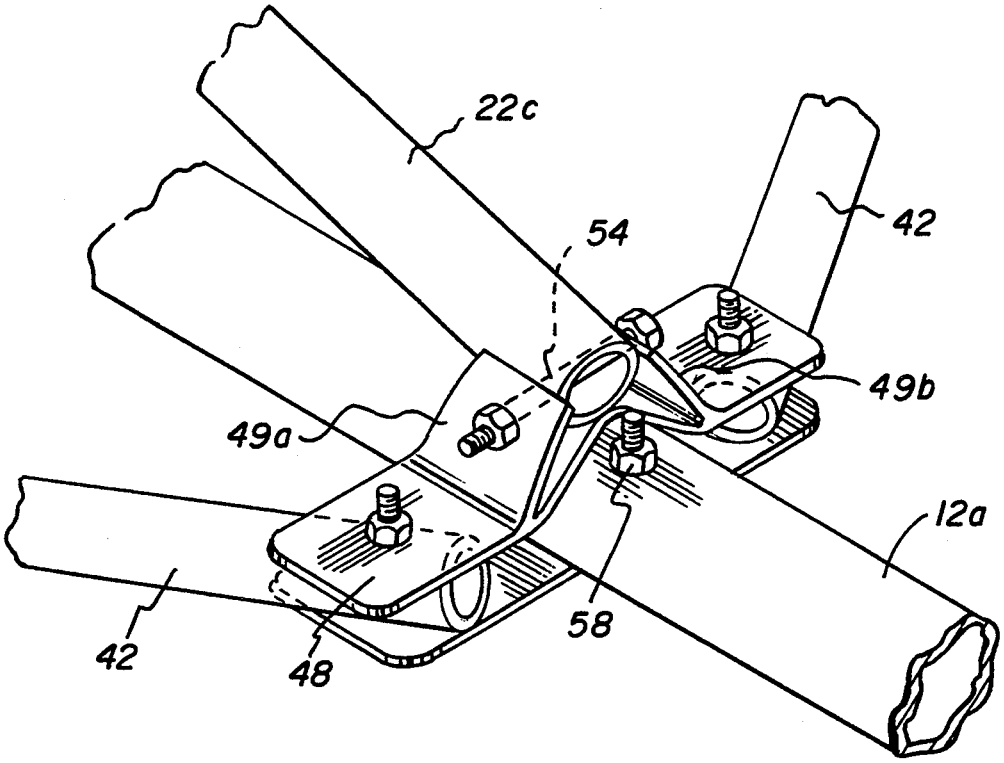
FIG. 8*a* is an enlarged perspective view of a first embodiment of a sliding bracket according to the first embodiment of the present invention shown in FIGS. 1–7.

In order to provide additional support, each upright support member 14 and 16 is provided with a plurality of struts 2,2. According to the preferred embodiment shown in FIGS. 1–7, three struts 22*a*, 22*b* and 22*c* are provided. Struts 22*a* and 22*b* are pivotally attached to slider blocks 50*a* and 50*b* respectively. Each slider block 50*a* and 50*b* is disposed about and slides along a surface of an elongated support member 40 of one of said outriggers 36 and 38, respectively. In the collapsed configuration, as shown in FIGS. 1–3, the slider blocks 50*a* and 50*b* abut ends of the stationary bracket 46. In the fully extended configuration as shown in FIGS. 6 and 7, the slider blocks 50*a* and 50*b* abut hinges 44 of outriggers 36 and 38, respectively. A plate 52 is attached to struts 22*a* and 22*b* near a second end thereof for retaining the second ends of said struts in close proximity to one another. According to an alternative configuration as shown in FIG. 9, the plate 52 is configured to receive and retain the second ends of all three struts 22*a*, 22*b* and 22*c*. The struts rotate freely about their respective longitudinal axes at the points of connection to said plate 52. As best seen in FIG. 8*a*, a third strut 22*c* is pivotally attached to the sliding bracket 48 by a fastener 54 such as a bolt or rivet, which passes through flanges 49*a* and 49*b* of the sliding bracket 48 and through a first end of said strut 22*c*. According to this configuration, the sliding bracket 48 includes two pieces: a one-piece lower plate secured to a one-piece upper plate by a plurality of fasteners, such as bolts or rivets. In an alternative configuration shown in FIG. 8*b*, the sliding bracket 48 includes three pieces. The sliding bracket according to this configuration includes an upper plate having two pieces 48*a* and 48*b*, each of which is secured to a one-piece lower plate by a plurality of fasteners, such as bolts or rivets. Each piece of the upper plate 48*a* and 48*b* exhibits and upwardly extending flange 49*a* and 49*b* respectively, for receiving and securing a first end of the strut 22*c*. As best seen in FIG. 7, the second ends of struts 22*a*, 22*b* and 22*c* are detachably connected to an upright support member by a fastener 56, such as a pin which, as illustrated, passes through the upright support member, or in other configurations, latitudinally through the upright support member.

Figure 11:
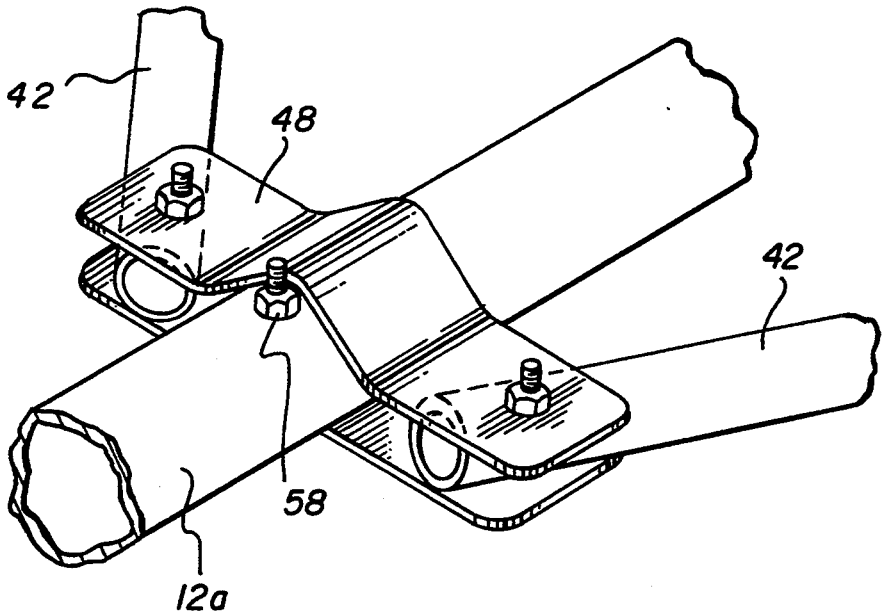
FIG. 11 is an enlarged perspective view of one of the sliding brackets according to the alternative embodiment shown in FIG. 9.
Figure 10:
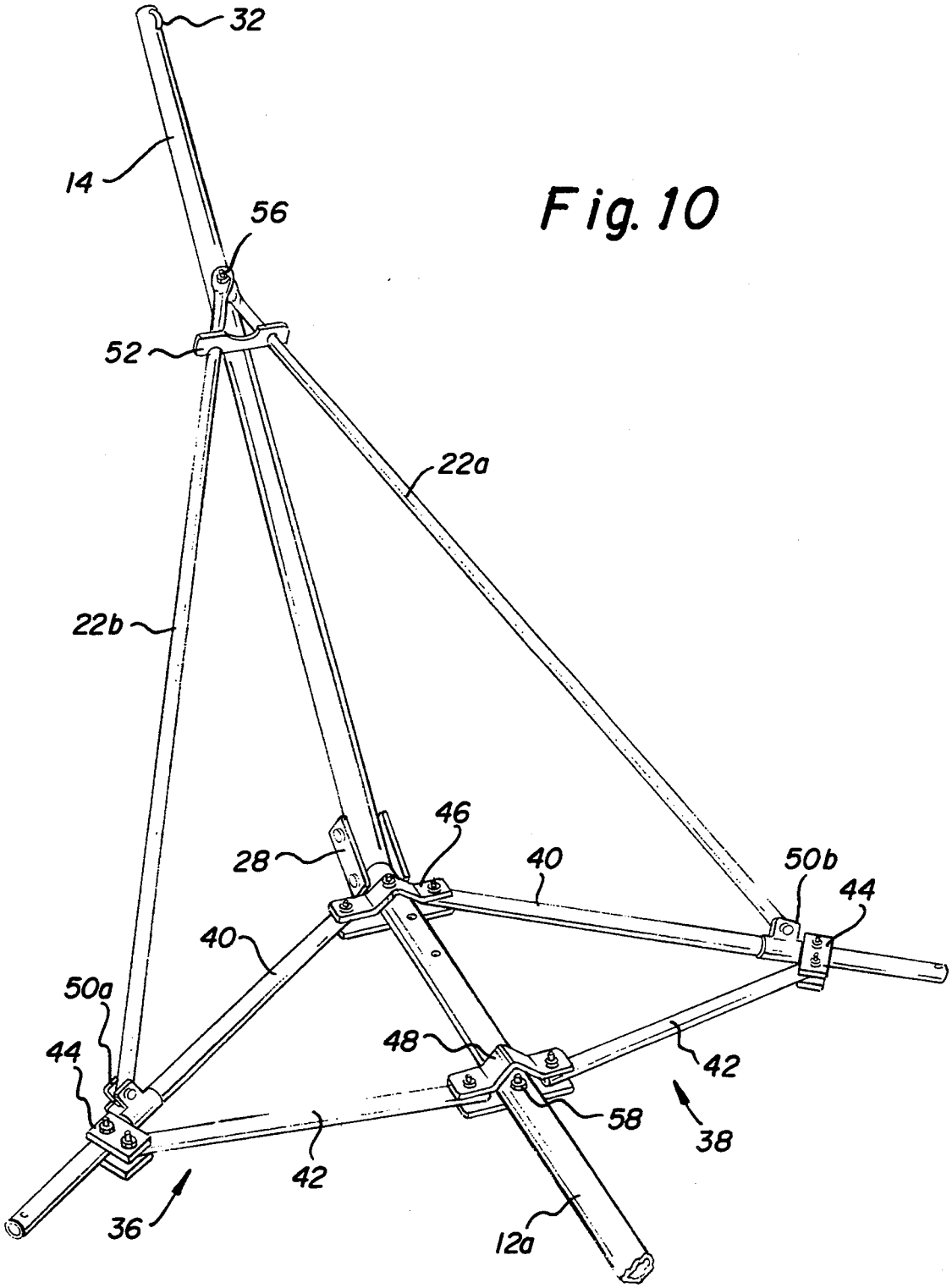
FIG. 10 is an enlarged perspective view of one end of an alternative embodiment of the invention.

A hammock stand according to an alternative embodiment of the invention is shown in FIGS. 10 and 11. The hammock stand of this embodiment is similar to the embodiment shown in FIGS. 1–9, wherein like reference numerals indicate like components. However, the hammock stand 13 according to the alternative embodiment is provided with only two struts 22*a* and 22*b*. Furthermore, the hinges 44 of outriggers 36 and 38 are located near the midpoint of the first elongated support members 40 according to this embodiment. The hammock stand according to this alternative embodiment is slightly more compact in its folded configuration. However, the alternative embodiment provides slightly less longitudinal stability than the three strut design of the preferred embodiment shown in FIGS. 1-9. Furthermore, lighter materials may be used with the three strut design according to the preferred embodiment.

The various components of the hammock stand are preferably fabricated from light weight aluminum or an alloy thereof. It is also contemplated to fabricate the components of the hammock stand from rigid polymeric materials such as nylon, polypropylene, polyvinylchloride or composite fiber.

The illustrated embodiments are shown by way of example. The spirit and scope of the invention is not to be restricted by the preferred embodiments shown.

What is claimed is:

1. A collapsible hammock stand comprising:

a base member;

a first lateral support member connected to a first end of said base member and moveable from a collapsed position to an extended position;

a second lateral support member connected to a second end of said base member and moveable from a collapsed position to an extended position;

a first substantially upright support member having a first end pivot mounted to said first end of said base member and moveable between a collapsed position and an extended, substantially upright position; said first substantially upright support member supporting a first end of a hammock when said hammock stand is in an extended position;

a second substantially upright support member having a first end pivot mounted to said second end of said base member and moveable between a collapsed position and an extended, substantially upright position; said second substantially upright support member supporting a second end of said hammock when said hammock stand is in an extended position;

a first plurality of bracing supports, each having a first end pivot mounted to said first lateral support member and a second end removably attached to said first upright support member when said hammock stand is in an extended position; and a second plurality of bracing supports, each having a first end pivot mounted to said second lateral support member and a second end removably attached to said second upright support member when said hammock stand is in an extended position.

2. A collapsible hammock stand according to claim 1, wherein said first and second lateral support members each further comprises:

a stationary bracket fixedly attached to an end of said base member;

a sliding bracket disposed about and slidable along a surface of said base member;

a first outrigger having a first end connected to said stationary bracket and a second end connected to said sliding bracket; said first outrigger moveable from a collapsed position along a first longitudinal side of said base member to a position extending laterally outward from said first side of said base member; and a second outrigger having a first end connected to said stationary bracket and a second end connected to said sliding bracket; said second outrigger moveable from a collapsed position along a second longitudinal side of said base member to a position extending laterally outward from said second side of said base member.

3. A collapsible hammock stand according to claim 2, wherein said first and second outriggers each comprises:

a first elongated member having a first end pivot mounted to said stationary bracket; and a second elongated member having a first end pivot mounted to said sliding bracket and a second end pivot mounted to said first elongated member.

4. A collapsible hammock stand according to claim 3, wherein said second elongated member is connected to said first elongated member at a second end of the first elongated member.

5. A collapsible hammock stand according to claim 3, wherein said second elongated member is connected to said first elongated member near a midpoint of the first elongated member.

6. A collapsible hammock stand according to claim 2, wherein said first and second plurality of bracing supports each comprises two bracing supports.

7. A collapsible hammock stand according to claim 6, further comprising:

a first sliding collar slide mounted on a surface of said first outrigger; said first one of said plurality of bracing supports pivot mounted to said first sliding collar; and a second sliding collar slide mounted on a surface of said second outrigger; said second one of said plurality of bracing supports pivot mounted to said second sliding collar.

8. A collapsible hammock stand according to claim 7, further comprising a retaining member proximal to and disposed about said second end of said first one of said plurality of bracing supports and said second end of said second one of said plurality of bracing supports for retaining said second end of said first bracing support in close proximity to said second end of said second bracing support.

9. A collapsible hammock stand according to claim 2, wherein said first and second plurality of bracing supports each comprises three bracing supports.

10. A collapsible hammock stand according to claim 9, further comprising:

a first sliding collar slide mounted on a surface of said first outrigger; said first one of said plurality of bracing supports pivot mounted to said first sliding collar;

a second sliding collar slide mounted on a surface of said second outrigger; said second one of said plurality of bracing supports pivot mounted to said second sliding collar; and a third one of said plurality of bracing supports is pivot mounted to said sliding bracket.

11. A collapsible hammock stand according to claim 10, further comprising a retaining member proximal to and disposed about said second end of said first one of said plurality of bracing supports and said second end of said second one of said plurality of bracing supports for retaining said second end of said first bracing support in close proximity to said second end of said second bracing support.

12. A collapsible hammock stand according to claim 10, further comprising a retaining member proximal to and disposed about said second ends of said first, second and third bracing supports for retaining said second ends of said first, second and third bracing supports in close proximity to one another.

13. A collapsible hammock stand according to claim 1, wherein said first and second plurality of bracing supports each comprises three bracing supports.

14. A collapsible hammock stand according to claim 13, further comprising:

a first sliding collar slide mounted on a surface of said lateral support member; said first one of said plurality of bracing supports pivot mounted to said first sliding collar;

a second sliding collar slide mounted on a surface of said lateral support member; said second one of said plurality of bracing supports pivot mounted to said second sliding collar; and a third one of said plurality of bracing supports is pivot mounted to said lateral support member.

15. A collapsible hammock stand according to claim 14, further comprising a retaining member proximal to and disposed about said second end of said first one of said plurality of bracing supports and said second end of said second one of said plurality of bracing supports for retaining said second end of said first bracing support in close proximity to said second end of said second bracing support.

16. A collapsible hammock stand according to claim 14, further comprising a retaining member proximal to and disposed about said second ends of said first, second and third bracing supports for retaining said second ends of said first, second and third bracing supports in close proximity to one another.

17. A collapsible hammock stand according to claim 1, wherein said first and second plurality of bracing supports each comprises two bracing supports.

18. A collapsible hammock stand according to claim 17, further comprising:

a first sliding collar slide mounted on a surface of said lateral support member; said first one of said plurality of bracing supports pivot mounted to said first sliding collar; and a second sliding collar slide mounted on a surface of said lateral support member; said second one of said plurality of bracing supports pivot mounted to said second sliding collar.

19. A collapsible hammock stand according to claim 17, further comprising a retaining member proximal to and disposed about said second end of said first bracing support and said second end of said second bracing support for retaining said second end of said first bracing support in close proximity to said second end of said second bracing support.

20. A collapsible hammock stand according to claim 1, wherein said base member further comprises a first base member hinged to a second base member, said first and second base members being moveable from a collapsed position to an extended, substantially in-line position.

21. A collapsible hammock stand according to claim 1, wherein said collapsible hammock stand comprises a one-piece structure.

* * * * *